US006564411B2

(12) United States Patent
Pirzada

(10) Patent No.: US 6,564,411 B2
(45) Date of Patent: May 20, 2003

(54) ACTIVE FLUID CHANNELING SYSTEM FOR A BED

(76) Inventor: Shahzad Pirzada, 1 Tiffany Cir., Manhasset, NY (US) 11030

( * ) Notice: Subject to any disclaimer, the term of this patent is extended or adjusted under 35 U.S.C. 154(b) by 143 days.

(21) Appl. No.: 09/812,166

(22) Filed: Mar. 19, 2001

(65) Prior Publication Data

US 2002/0129448 A1 Sep. 19, 2002

(51) Int. Cl.[7] ..... A47C 27/10
(52) U.S. Cl. ..... 5/713; 5/710; 5/709
(58) Field of Search ..... 5/709, 710, 713, 5/727

(56) References Cited

U.S. PATENT DOCUMENTS

| | | | | | |
|---|---|---|---|---|---|
| 3,875,599 | A | * | 4/1975 | Mracek et al. | 5/706 |
| 4,371,997 | A | | 2/1983 | Mattson | |
| 4,435,864 | A | | 3/1984 | Callaway | |
| 4,888,836 | A | * | 12/1989 | Calderwood | 5/707 |
| 4,907,307 | A | * | 3/1990 | Weitzler | 5/706 |
| 5,052,067 | A | * | 10/1991 | Thomas et al. | 5/713 |
| 5,103,519 | A | * | 4/1992 | Hasty | 5/715 |
| 5,142,717 | A | | 9/1992 | Everard et al. | |
| 5,388,292 | A | | 2/1995 | Stinson et al. | |
| 5,421,044 | A | * | 6/1995 | Steensen | 5/710 |
| 5,584,085 | A | * | 12/1996 | Banko | 5/710 |
| 5,634,224 | A | | 6/1997 | Gates | |
| 5,634,225 | A | * | 6/1997 | Miller et al. | 5/710 |
| 5,685,036 | A | * | 11/1997 | Kopfstein et al. | 5/710 |
| 5,920,934 | A | * | 7/1999 | Hannagan et al. | 5/713 |
| 6,014,784 | A | * | 1/2000 | Taylor et al. | 5/713 |
| 6,047,423 | A | * | 4/2000 | Larson | 5/713 |
| 6,092,249 | A | | 7/2000 | Kamen et al. | |
| 6,108,843 | A | * | 8/2000 | Suzuki et al. | 5/713 |
| 6,122,785 | A | | 9/2000 | Bondie et al. | |
| 6,266,833 | B1 | * | 7/2001 | Lin | 5/713 |
| 6,269,505 | B1 | * | 8/2001 | Wilkinson | 5/710 |
| 6,349,439 | B1 | * | 2/2002 | Cook et al. | 5/713 |
| 6,412,129 | B1 | * | 7/2002 | Wu | 5/710 |

* cited by examiner

*Primary Examiner*—Heather Shackelford
*Assistant Examiner*—Frederick L. Lagman
(74) *Attorney, Agent, or Firm*—Collard & Roe, P.C.

(57) ABSTRACT

An fluid channeling system that comprises a series of elongated chambers having a rectangular cross section. Each of these chambers is disposed adjacent to the other and extends parallel to the other in either a single layer configuration or a two layer configuration. There is at least one fluid such as air, helium, or an air helium combination disposed within these chambers. The fluid enters these chambers through at least one fluid intake valve which is in fluid communication with these chambers. Helium has particular properties that make it conducive for this type of an application. Helium is odorless, colorless, and tasteless, in addition, Helium can diffuse through many materials commonly used in laboratories such as rubber and PVC. Therefore, if the present invention uses Helium, the materials used in creating this device must reflect these properties. There is also at least one fluid conveyor such as a series of pipes or a series of pipes and a manifold wherein the fluid conveyor conveys the fluid between alternating chambers in the series of chambers. These chambers may also contain a resilient material such as a polyurethane foam that is porous to the fluid. As a load is a applied to the chambers, the chambers alternately compress or expand causing fluid to flow in through the intake valves and into the chambers. The fluid stops flowing into the chambers when the pressure inside the chambers balance with the pressure outside the chambers.

30 Claims, 11 Drawing Sheets

ACTIVE FLUID CHANNELING SYSTEM FOR A BED

BACKGROUND OF THE INVENTION

Field of the Invention

The invention relates to an active fluid channeling system for a bed. The fluid channeling system is designed to equalize the pressure within a series of chambers inside the bed to evenly displace a user's weight across this bed reduce the occurrence of bed sores and improve comfort.

SUMMARY OF THE INVENTION

The invention relates to a fluid channeling system for a bed. This fluid channeling system comprises a series of chambers that may be formed as elongated chambers having a rectangular cross section. Each of these chambers is disposed adjacent to each other and extend parallel to each other. In a first embodiment of the invention the chambers are positioned in two layers with a first layer of chambers on top of a second layer of chambers. In a second embodiment of the invention the chambers are positioned adjacent to each other in only one layer.

These chambers are defined by a material that is substantially airtight. There is at least one fluid such as air, helium, or an air helium combination disposed within each of these chambers. The fluid enters these chambers through at least one fluid intake valve which is in fluid communication with these chambers. Helium has particular properties that make it conducive for this type of an application. Helium is odorless, colorless, and tasteless. However, Helium can diffuse through many materials commonly used in laboratories such as rubber and PVC. Therefore, if the present invention uses Helium, the materials used in creating this device must reflect these properties.

There is also at least one fluid conveyor such as a series of pipes or a series of pipes and a manifold connecting these pipes wherein the fluid conveyor conveys the fluid between alternating chambers in the series of chambers. In the first embodiment, with the fluid chambers in the stacked position, the pipes connect alternating chambers with a chamber in the top row being connected in a diagonal manner with a chamber in a bottom row. In the second embodiment of the invention, with the chambers being in a single row, the pipes connect alternating chambers in this row.

The chambers in the fluid channeling system may be simply filled with fluid or also contain a resilient material such as a polyurethane foam disposed within these chambers, wherein the foam is designed to resist the application of a load applied to the series of chambers. This foam can also be porous to the passage of the fluid.

This device may also contain a manually actuatable relief valve. The manually actuatable relief valve may be a twisty valve, a ball valve or a quick release connection such as a CPC connection marketed by the Coulter Products Company. The relief valve is designed to allow a user to deflate the mattress when shipping the mattress. In addition, the user may also wish to reset the pressure within the mattress by briefly opening the manually actuatable relief valve and letting all of the fluid out of the valve.

This device is designed to equalize the fluid pressure within the chambers and the air pressure outside the chambers so that a user lying on this cushioning device would have his or her body balanced on the cushioning device. Essentially this cushioning device can be in the form of a seat cushion or a bed.

When a load is placed on the chambers, at least one of the chambers is compressed creating a recessed chamber. When the load is released, the resilient material expands in the compressed chamber, thus expanding the compressed chamber causing the fluid to enter the series of chambers. This fluid flows through the fluid conveyor to alternating chambers. Because the fluid flows to an alternate chamber and not to an adjacent chamber, this design helps to improve the circulation of fluid through the system. For example if fluid only flowed from one chamber into an adjacent chamber, then this fluid would not circulate as much throughout the cushioning device to chambers positioned away from the affected chambers. This is because the fluid would have to travel through a first adjacent chamber and then on to a second chamber adjacent to the first adjacent chamber to reach an alternate chamber. Instead, because only alternate chambers are connected together the fluid flows directly into the alternate chamber instead of just into the adjacent chamber.

There is also a method for cushioning a load. This method includes the following steps:

providing a series of chambers;

providing at least one selectively openable fluid intake valve in fluid communication with the series of chambers;

providing at least one fluid conveyor for providing fluid communication between alternating chambers;

applying a load to at least one of the chambers;

relieving at least a portion of the load from at least one of the chambers;

opening said at least one intake valve to receive said at least one fluid into said series of chambers;

communicating fluid from at least one of the chambers to alternating chambers wherein the fluid flows through the intake valve and communicates with alternating chambers until a fluid pressure inside of the chambers balances with a pressure outside of the chambers.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings wherein similar reference characters denote similar elements throughout the several views.

DETAILED DESCRIPTION OF THE PREFERRED EMBODIMENT

Figure 1:
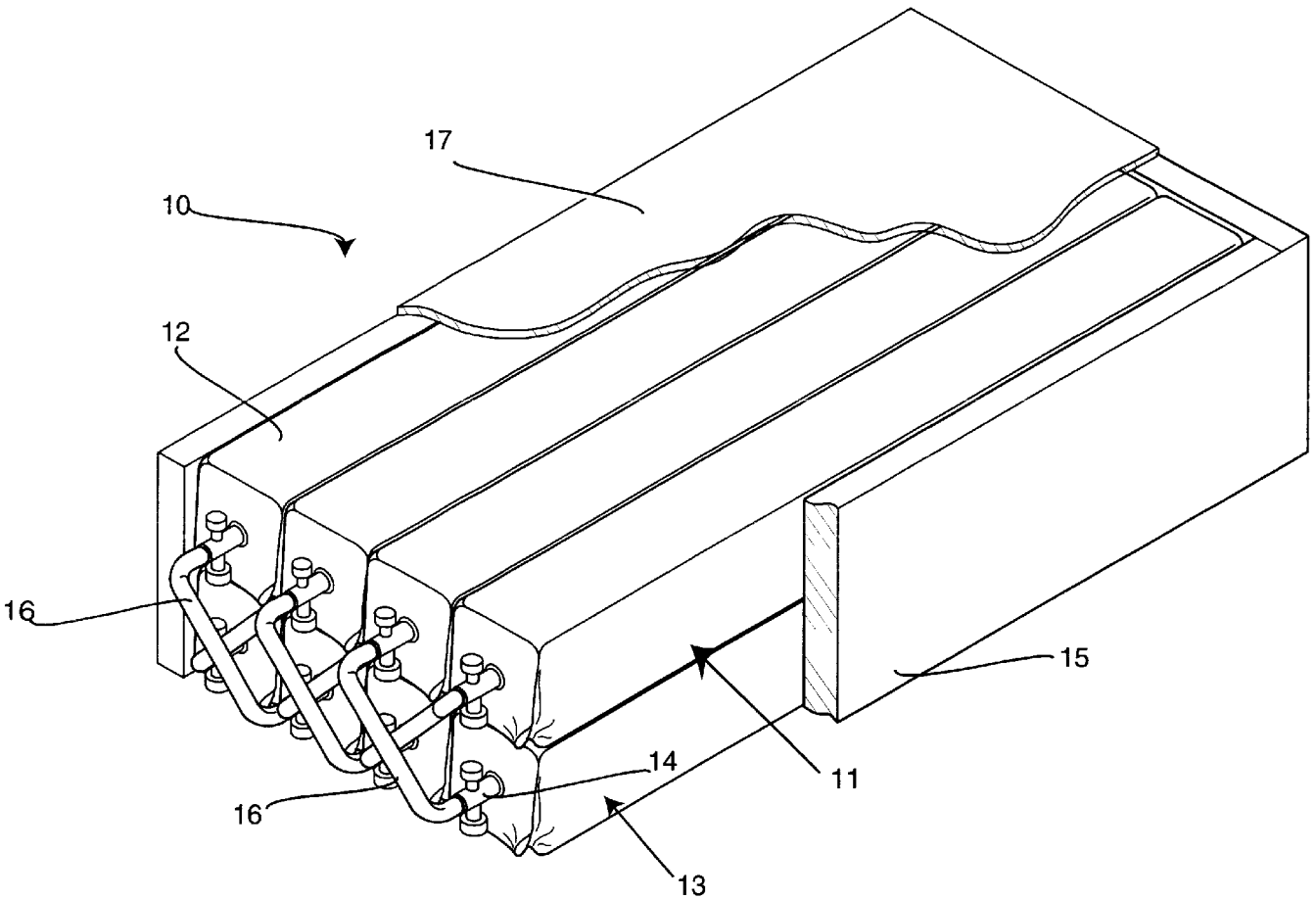
FIG. 1 is a perspective view of the invention.

FIG. 1 refers to a top view of a first embodiment of an fluid channeling system 10 for a mattress. There is a first series 11 of elongated chambers 12 forming a top row wherein these chambers 12 are arranged parallel to each other to form a mattress or cushioning device. There is also a second series 13 of elongated chambers 12 forming a bottom row disposed below first series 11. Chambers 12 are in fluid communication with each other via a series of pipes 14 that are connected to alternate chambers. Pipes 14 are connected to each other and in fluid communication with each other via a manifold or connecting pipe 16 which connects chambers 12 throughout system 10. For example, pipes 14 and manifold 16 connect a chamber 12 in first series 11 to an alternate chamber 12 in a second series 13. With this design, fluid can then flow from chambers 12 in first series 11 to alternating chambers in second series 13. As shown in FIG. 1, pipes 14 and manifold 16 are connected in a crisscrossed manner. These chambers can be encased in a side panel 15 and a top padding 17.

The fluid may be comprised of air or helium or a combination of the two gasses. The mixture of air and helium may comprise 40 wt % He and 60 wt % of air. Helium may be beneficially used in this system as a liquid because it is more thermally reactive than air alone. Therefore, when a user lies down on system 10 the body heat of the user will cause the Helium within the fluid to expand within chambers 12 to accommodate the increased pressure. In addition, the helium that is included with the fluid is able to diffuse through many materials commonly used in laboratories such as polyvinyl chloride. Therefore, the chambers 12, pipes 14 and manifold 16 are made from materials that do not allow helium to escape.

Figure 2:
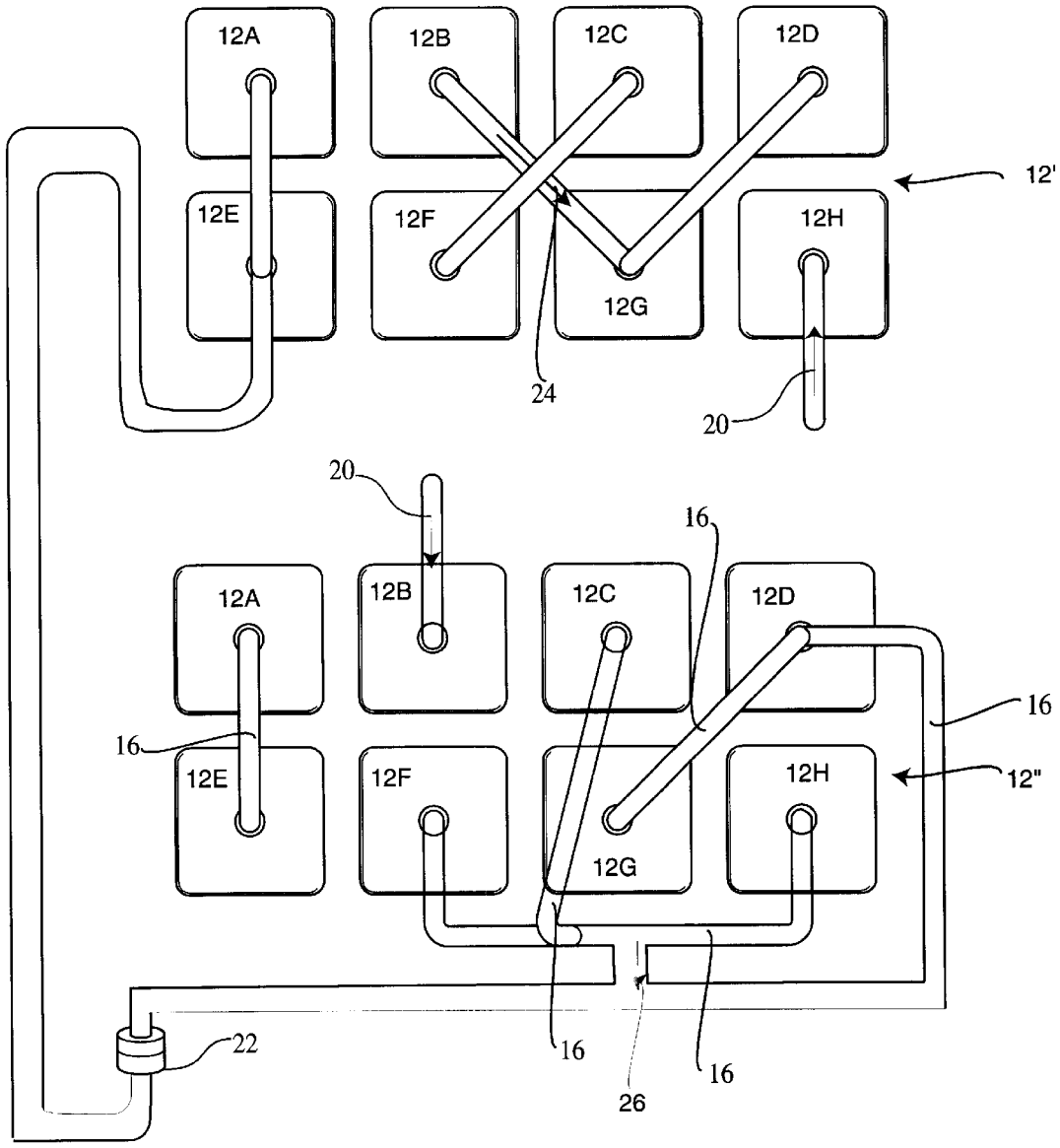
FIG. 2 is a schematic view of the connection of a series of fluid communication elements.

FIG. 2, shows the stacked system as shown in FIG. 1 however, FIG. 2 shows an alternate connection pattern. In this view, intake valves 20 are connected to chamber 12H on one side 12' of the chambers and an additional intake valve 20 is also disposed in chamber 12B on an opposite side 12" of these chambers. These intake valves are either open to receive outside air or these intake valves can be connected to a chamber of helium (not shown). In addition, as shown in FIG. 2, there are no two adjacent chambers 12 connected to each other in the same row such as first series 11, or second series 13. Thus, with this design, fluid will circulate throughout alternating chambers 12 in the fluid channeling system rather than remain circulating between two adjacent chambers. In addition, there is also a manually actuatable relief valve 22 that is designed to allow air to be relieved from the system when the valve has been opened. This manually actuatable relief valve 22 can be a quick release connection or CPC connection, a ball valve, or a twisty valve. This relief valve can then be opened to allow fluid to flow out of the system to either deflate the mattress or to reset the mattress for future inflation. Furthermore, there is also a one way valve 24 that is designed to restrict the flow of air in one direction from chamber 12B to chamber 12C. One way valve 24 restricts any backflow from chamber 12B to chamber 12G. Thus, the fluid will flow on to chamber 12G and then on to charters 12D, 12A, and 12E.

A second one way valve 26 could be optionally provided wherein this second one way valve would restrict the flow between chambers 12H, 12C, or 12F to manifold 16 connected to manual relief valve 22. With this connection, air would only be able to flow out of chambers 12H, 12C, or 12F and out of valve 22 and not in to chambers 12H, 12C or 12F from chambers 12A, 12B, 12D, 12G and 12E. Thus, if this one way valve 26 is placed in the system, it would virtually seal chambers 12A, 12B, 12D, 12G and 12E from chambers 12C, 12F, and 12H creating two separate air flow systems each having an air intake valve 20.

For example, if a user lies down on the device 10, air will flow into intake valves 20 such that in a first instance, air will flow into chamber 12H on side 12', on to chamber 12F or onto chamber 12C via manifold 16 on side 12". Air will also flow out of chamber 12F and onto chamber 12C on side 12'.

In addition, air could also flow into valve 20, into chamber 12B on side 12", out of chamber 12B through one-way-valve 24 and into chamber 12G on said 12'. Air can then flow out of chamber 12G and into chamber 12D either from side 12' or side 12" of these chambers. Chamber 12D is also connected to chambers 12A and 12E via an interconnecting manifold 16 having a relief valve 22 disposed therein. To deflate the mattress, relief valve 22 can be opened, thus opening the system to the release of air or helium from the system.

Instead of entirely deflating the system, relief valve 22 could be opened to deflate the system, to allow this system to be reset. When a user lies down on chambers 12, pressure within chamber 12 increases to compensate the pressure applied to these chambers 12. This system should be reset each time a new user lies down on the system because each user has a different body type including size and weight distribution which would change the equilibrium pressure within the system.

Figure 3:
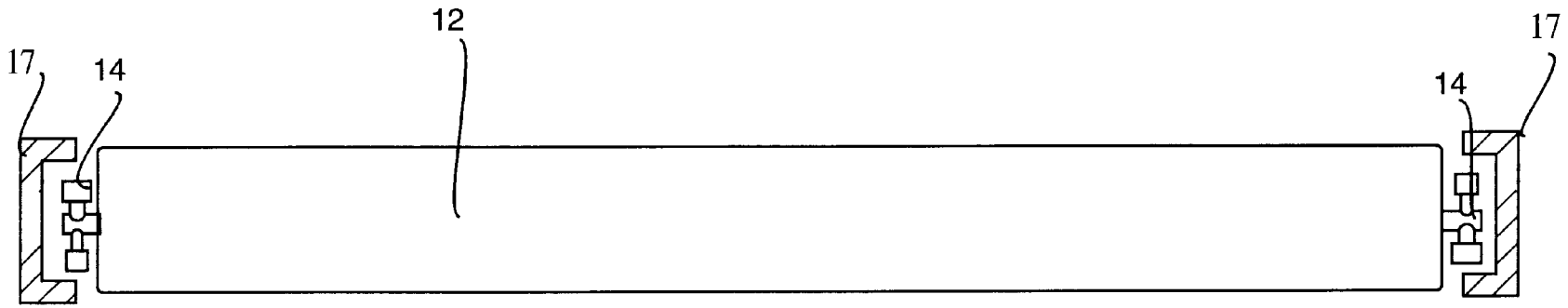
FIG. 3 is a side view of the second embodiment of the invention.
Figure 4:
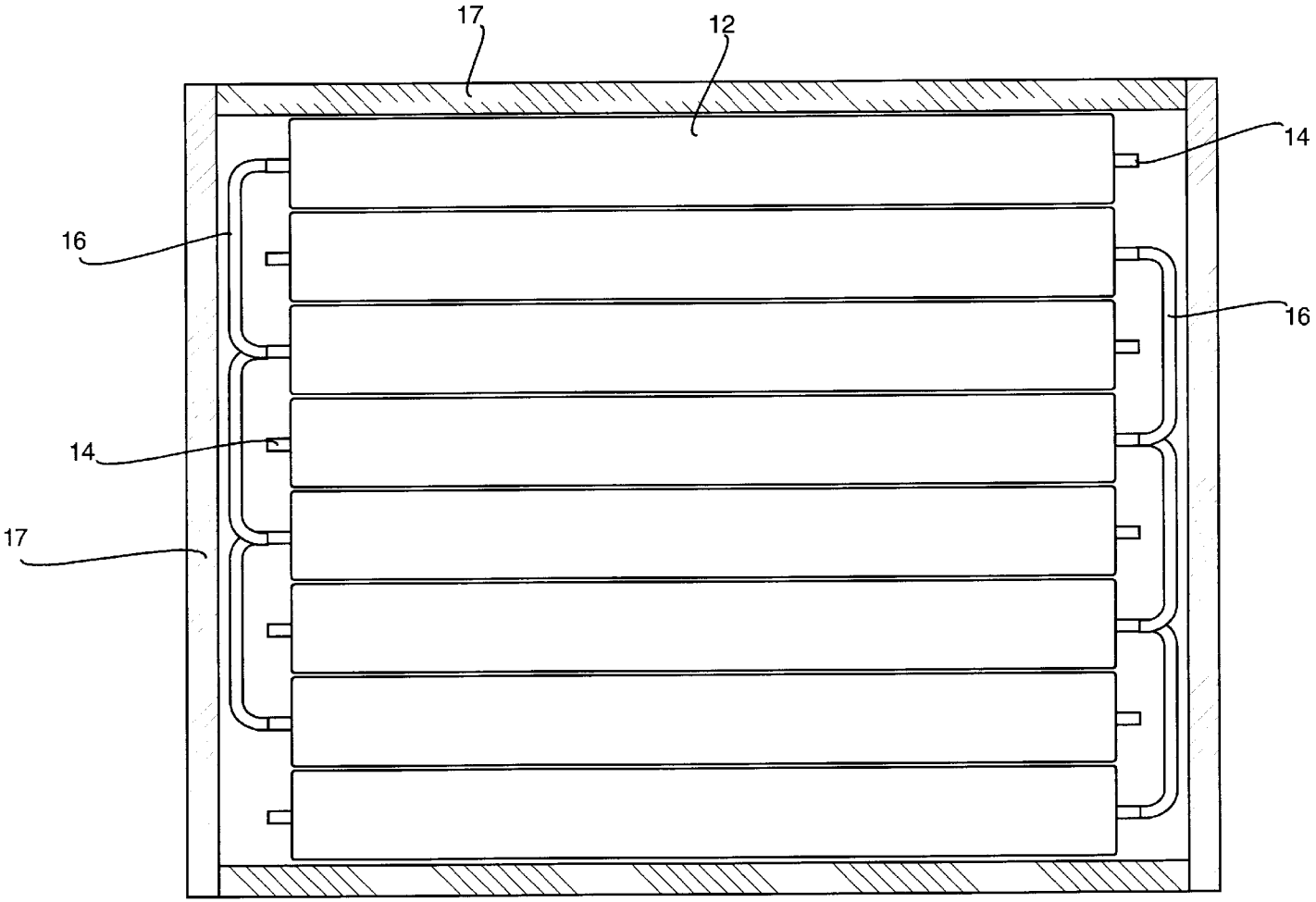
FIG. 4 is a top view of the second embodiment of the invention.

FIGS. 3 and 4 show the second embodiment of the invention. In this embodiment, chambers 12 are disposed adjacent to each other in a single row. Chambers 12 are connected to each other in an alternating matter so that pipes 14 and manifolds 16 on one side 12' of chambers 12 connect to alternate chambers while pipes 14 and manifolds 16 connect alternate chambers together on an opposite side 12" of chambers 12. In addition, on each chamber 12, opposite each manifold connection 16, are a series of intake valves 20 that are designed to introduce air or helium from a helium chamber (not shown) into the system.

Figure 5A:
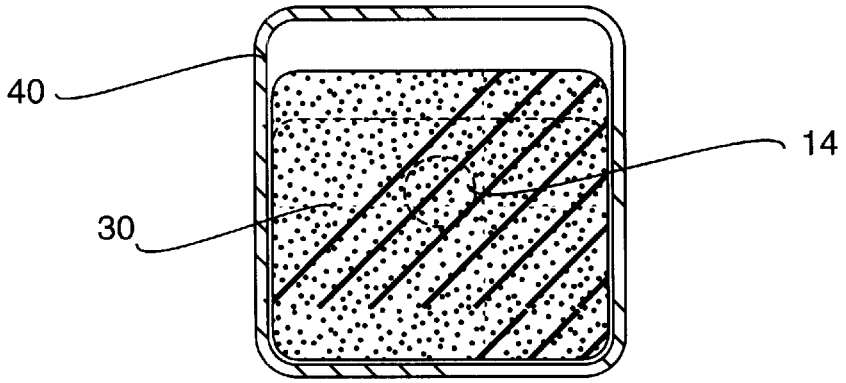
FIG. 5A is a cross-sectional view of a chamber having a foam insert that covers a majority of this chamber.
Figure 5B:
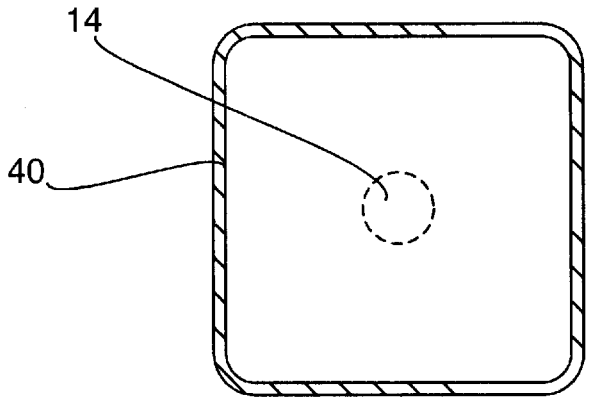
FIG. 5B is a cross-sectional view of a chamber without any foam inside.
Figure 5C:
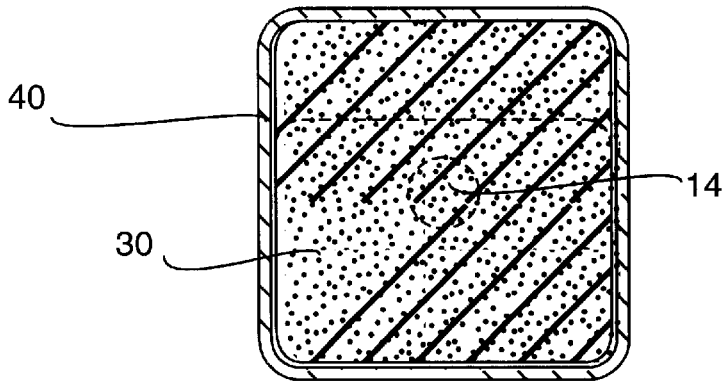
FIG. 5C is a cross-sectional view of a chamber having foam filling the chamber.

FIGS. 5A, 5B and 5C show a cross-sectional views of three different types of chambers 12. As shown in FIG. 5A, chamber 12 may be partially filled with foam, be vacant as in FIG. 5B, or be fully filled with a foam 30 as in FIG. 5C. Foam 30 can be made from a polyurethane and nylon composite. Chamber 12 contains a series of outer walls 40 that are connected together with a substantially rectangular cross section in a substantially airtight manner. Outer walls 40 are comprised of any resilient material such as polyvinyl chloride or any other type of cross linked polymer that is sufficiently resilient to withstand repeated loading while bouncing back and refilling with additional liquid such as air or helium.

Thus, when a user lies down on these chambers, the loaded chambers are first compressed driving fluid from these chambers into additional chambers in fluid communication with the loaded chambers. Since there are no outflow valves and chambers 12 are designed as substantially airtight, the fluid within the system is displaced around the system but not removed from the system. As a user rolls or moves on the affected chambers, this movement causes fluid flow within the chambers from this loading. This fluid flow creates a vacuum in these chambers drawing additional fluid into the chambers. Additional fluid enters chambers 12 through intake valves 20 which are either open to receive additional air or connected to an adjacent helium container. With both embodiments, on a single row, only alternate chambers 12 are connected to each other. Thus with this design, the circulation of fluid through the system is enhanced because the loading of a single chamber sends fluid into an alternate chamber instead of into an adjacent chamber. Thus, instead of having air circulating between adjacent chambers, the air bypasses these adjacent chambers and flows into alternate chambers instead.

This flow into alternate chambers is important because as a user lies down on a series of chambers the user's weight will be displaced across these chambers.

FIGS. 6–11 show the pressure mappings for a user as that user lies on one of the two embodiments shown in FIGS. 1 and 3, wherein the fluid is either air, helium, or an air helium mixture. With these pressure mappings, concentric areas are numbered wherein on all of these FIGS., regions 110, 120, 125, 130, 135, 140, 145, 150, 170, 190, and 200 all designate regions having a pressure rating in mm Hg of 10, 20, 25, 30, 35, 40, 45, 50, 70, 90, and 100 respectively. This pressure mapping is important to determine the correct system because any region on a user's body having a pressure rating of 60 or greater may result in a bedsore for that user.

This fluid circulation system is designed so that it reduces the bedsores in a user using this fluid circulation system. By having the fluid displace and circulate within chambers 12, this fluid flow provides sufficient displacement within the system to displace the pressure created by the weight of a user on chambers 12 across a series of chambers 12. Chambers 12 also create an opposite pressure on that user wherein if this pressure created by these chambers exceeds a particular level, that pressure may create bed sores on a user over an extended period of time. In many cases, this once the pressure created by these chambers exceeds 60 mm Hg then there is the possibility of bedsores. Therefore, the above two embodiments shown in this invention have been created to reduce the amount of pressure created by these chambers on a user by increasing the displacement of weight of that user across these chambers.

The pressure exerted by these chambers may be altered by either changing the composition of the fluid stored within these chambers, by altering the way in which these chambers are situated and providing two layers such as in the first embodiment or by altering the way in which these chambers are connected in one layer such as in the second embodiment to increase the fluid flow across the chambers, to improve the displacement across these chambers.

Two individuals or users were selected to study the pressure mappings on the two different embodiments wherein in both of these embodiments the fluid contained an air-helium mixture of 60% air 40% helium or a pure air solution. The first user is a 137 pound pregnant woman while the second user is a 198 pound male.

Figure 6:
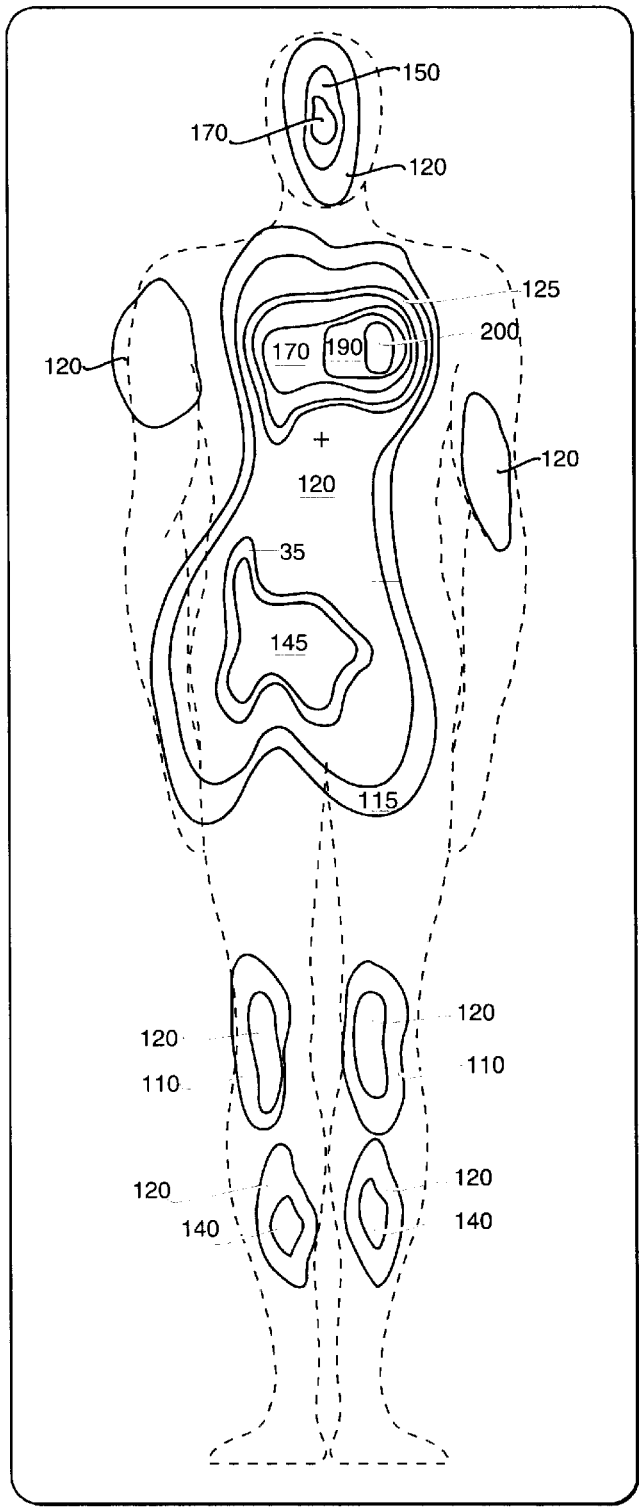
FIG. 6 is a pressure mapping showing the first user lying on the second embodiment of the invention having a fluid comprising air.

FIG. 6 shows a pressure mapping for a first user lying on the second embodiment or the one layer system having a fluid mixture of air. As shown in this pressure mapping, the user has pressure regions such as regions 200, 190, and 170 near the user's back and head that are above the 60 mm Hg threshold.

Figure 7:
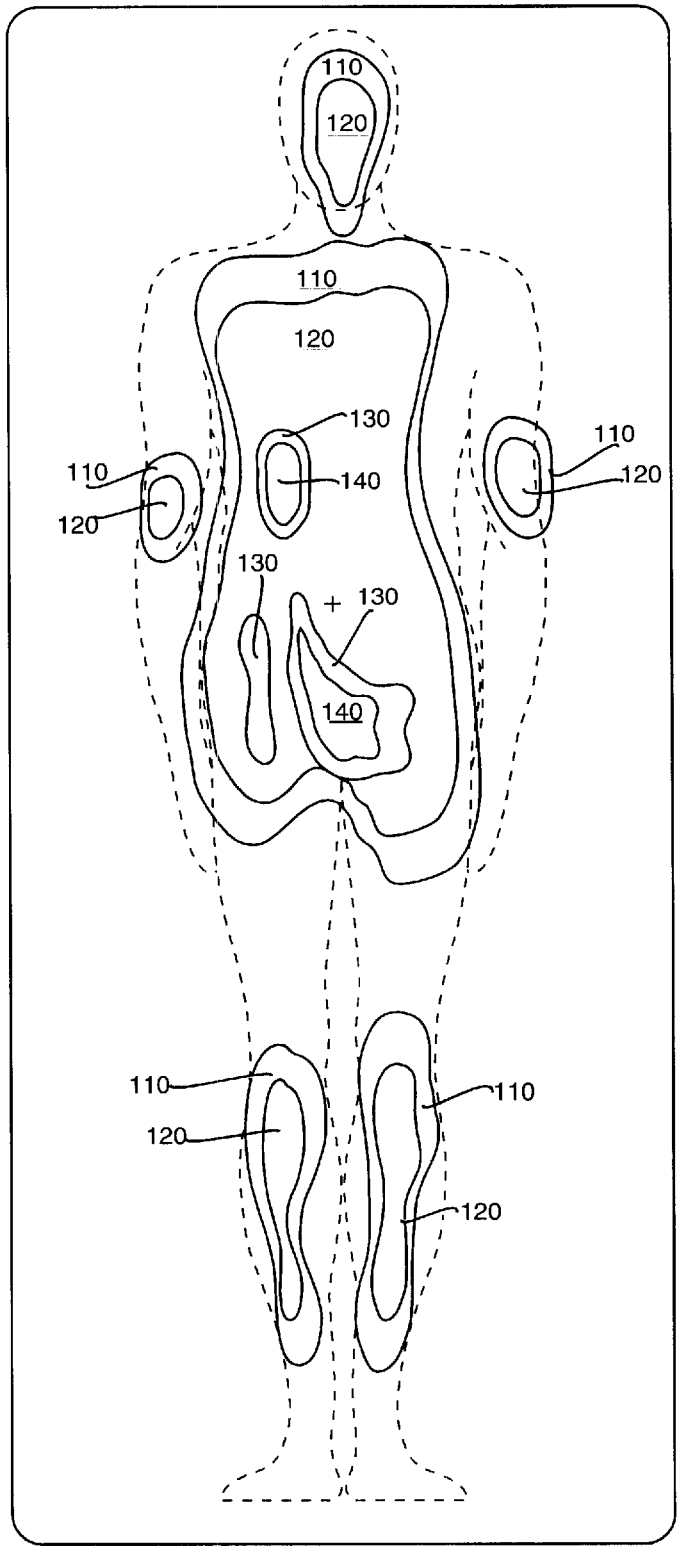
FIG. 7 is a pressure mapping showing the first user lying on the first embodiment of the invention having a fluid comprising air.

FIG. 7 is a pressure mapping for the first user lying on the first embodiment having a fluid mixture of air. With this design, there are no regions shown having a pressure rating of above 60 mm Hg. In fact, there are only a few regions 140 having a pressure rating reaching at least 40 mm Hg.

Figure 8:
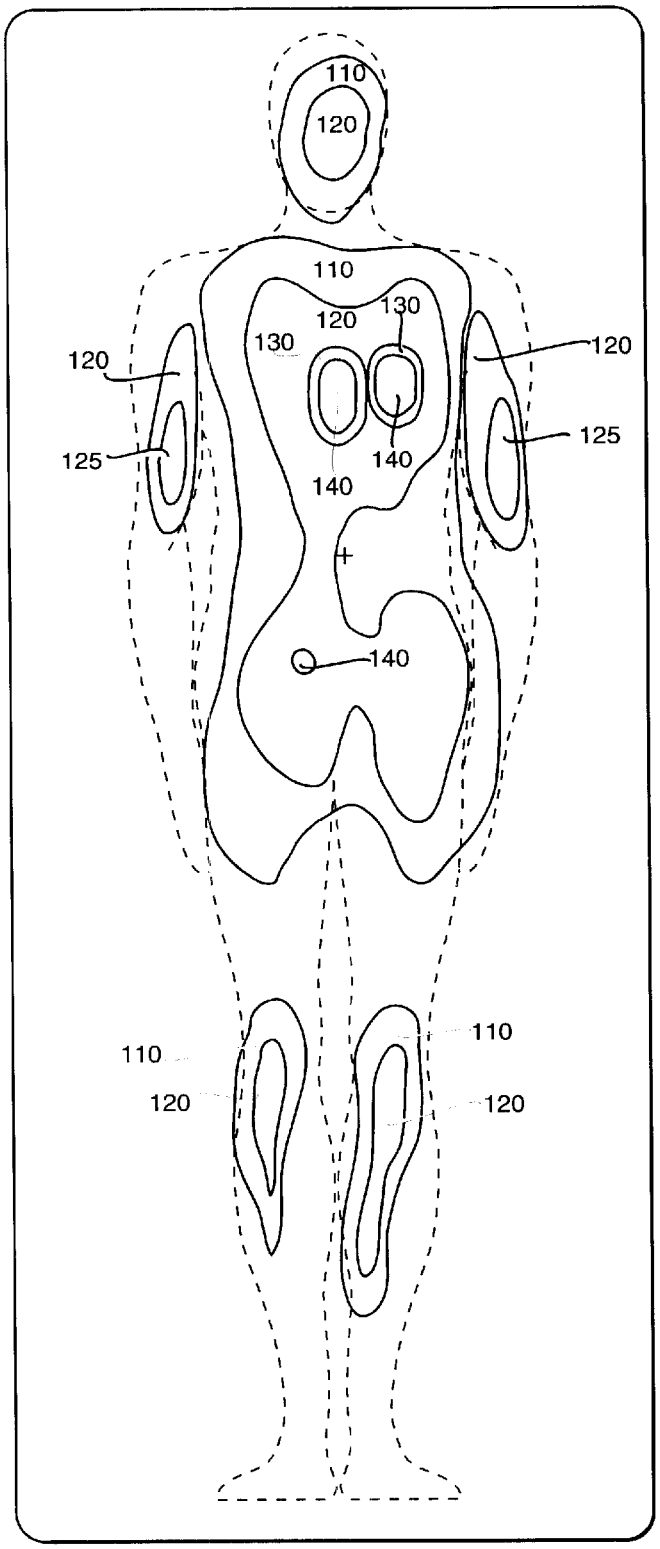
FIG. 8 is a pressure mapping showing the first user lying on the first embodiment of the invention having a fluid comprising air and helium.

FIG. 8 is a pressure mapping for the first user lying on the first embodiment having a fluid mixture of air and helium. As shown in this FIG., region 140 in and around a base region on a user's back has been dramatically reduced in size, thus indicating that the helium has improved the displacement of air across the mattress, thus reducing the amount of pressure placed on a user's back.

As shown in the progression through these FIGS. 6–8 the pressure mappings show a dramatic reduction in the amount of pressure placed on the user as the user switches from the second embodiment to the first embodiment and as helium is added to the system. These pressure mapping show concentric regions wherein the inner most concentric regions show the highest pressure rating.

Figure 9:
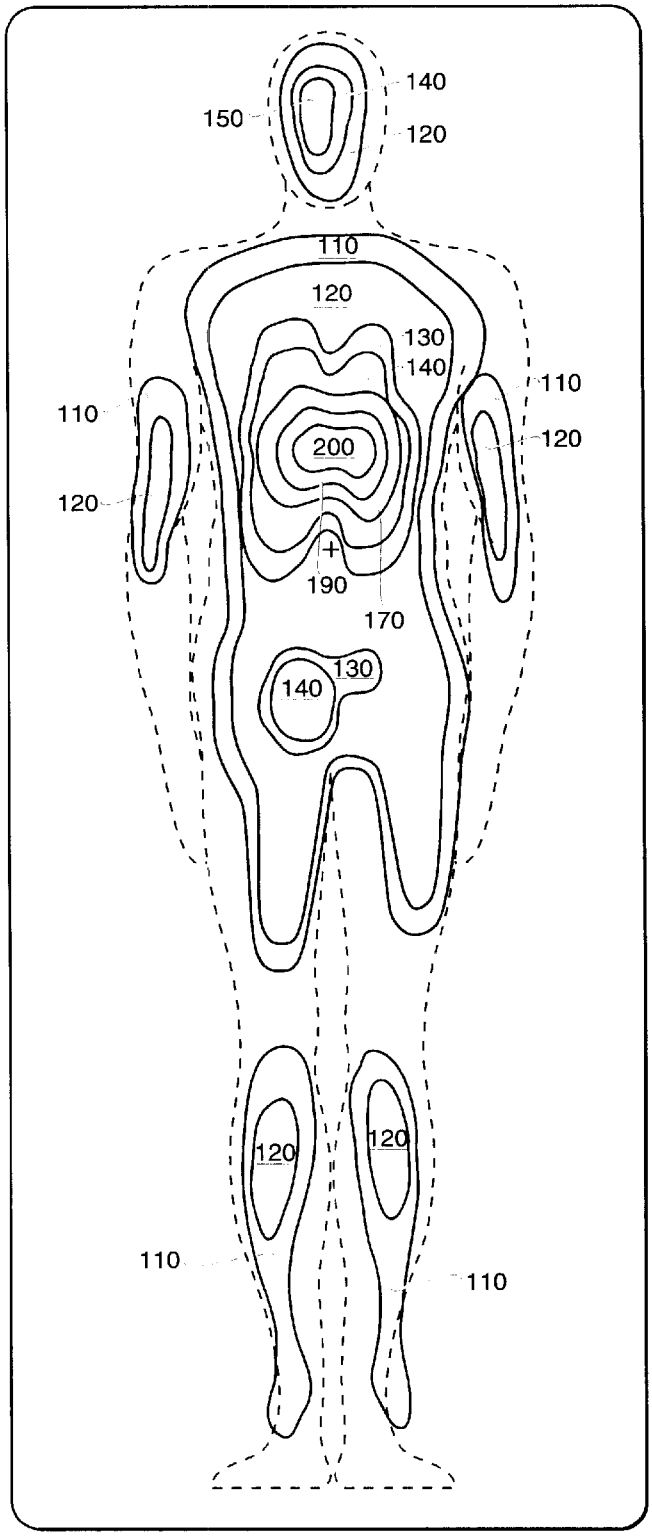
FIG. 9 is a pressure mapping showing the second user lying on the second embodiment of the invention having a fluid comprising air.

As for the second user, FIG. 9 is a pressure mapping for the second user lying on the second embodiment having a fluid mixture of air. With this design, in a central region of a user's back, are a series of substantially concentric regions 200, 190, and 170 that have pressure ratings of 100 mm Hg, 90 mm Hg, and 70 mm Hg which all rate above the 60 mm Hg threshold.

Figure 10:
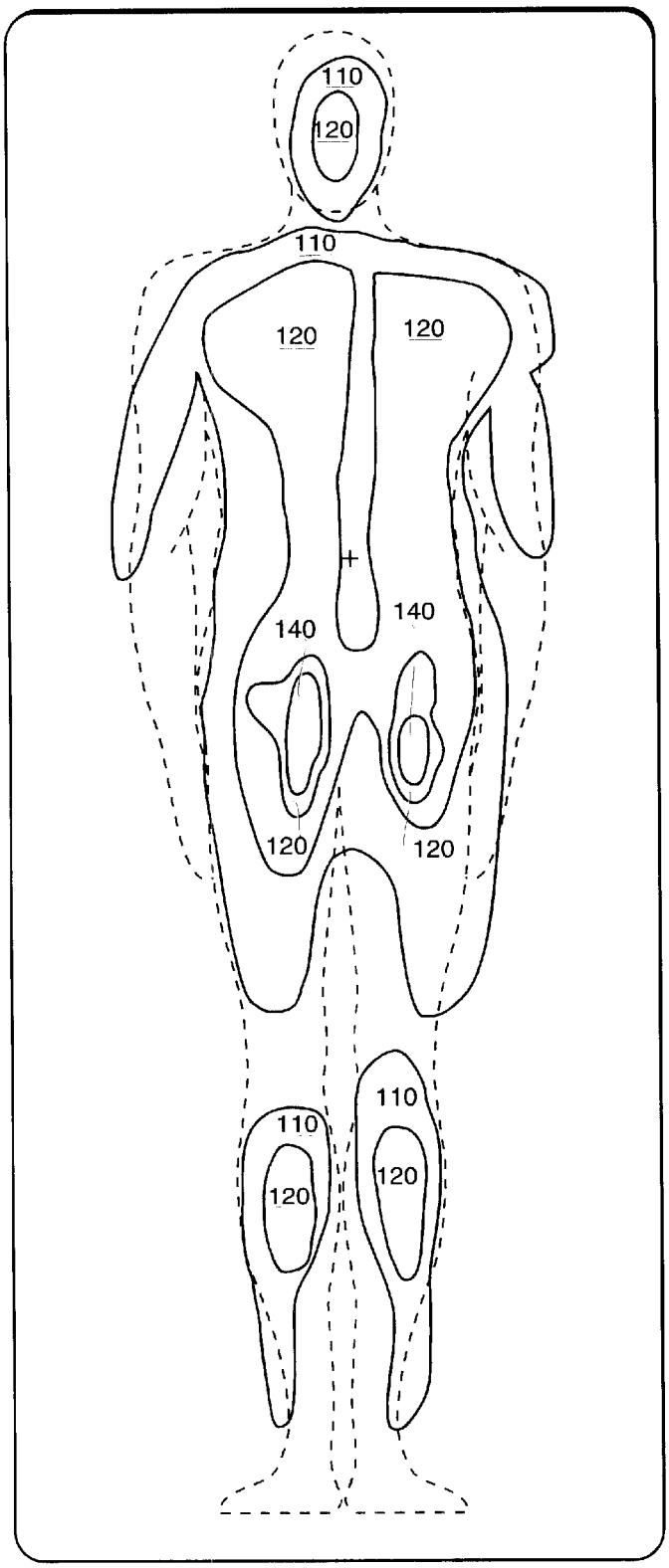
FIG. 10 is a pressure mapping showing second user lying on the first embodiment of the invention having a fluid comprising air.

FIG. 10 is a pressure mapping for the second user lying on the first embodiment having a fluid mixture of air. With this embodiment there are no pressure regions that rate above the 60 mm Hg threshold. In fact, regions 140 have the highest pressure ratings which rate up to only 40 mm Hg in pressure.

Figure 11:
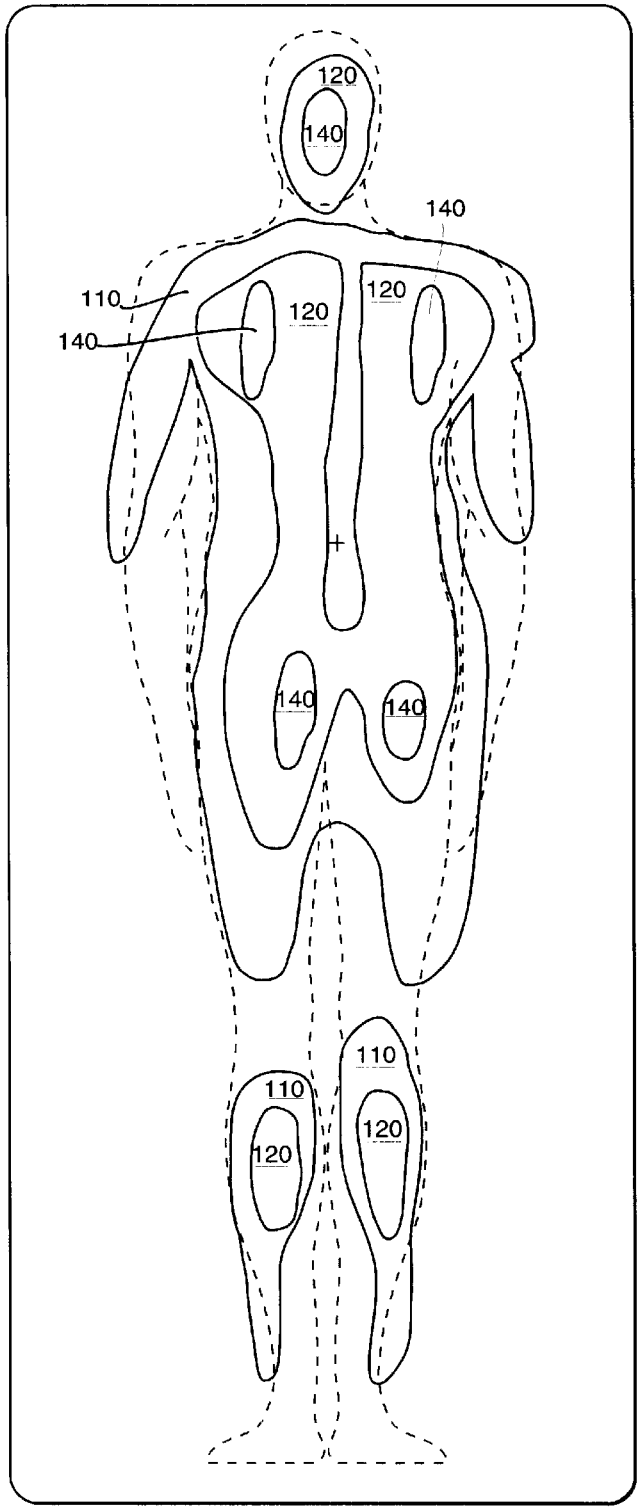
FIG. 11 is a pressure mapping showing the second user lying on the first embodiment of the invention having a fluid comprising air and helium.

FIG. 11 is a pressure mapping for the second user lying on the first embodiment having a fluid mixture of air. With this design, regions 140 in at the base of the user's back have been reduced in size.

Thus, as shown in the progression through these FIGS. 9–11, the amount of pressure placed on points on the user reduces as the second user switches from the second embodiment to the first embodiment and as helium is added to the first embodiment.

Thus, it is clear from the pressure mappings as shown in FIGS. 6–11 the use of a two layer system reduces the amount of pressure placed on a user when the user lies on the bed and also, the amount of pressure placed on the user is dramatically reduced when helium is introduced into the system.

Accordingly, while several embodiments of the present invention have been shown and described, it is to be understood that many changes and modifications may be made thereunto without departing from the spirit and scope of the invention as defined in the appended claims.

What is claimed is:

1. A nonpowered cushioning device comprising a) a series of chambers wherein each of said series of chambers are disposed adjacent to each other, said series of chambers comprising:

i) a first series of chambers forming a top layer;
ii) a second series of chambers forming a bottom layer;

b) at least one fluid disposed within said series of chambers;

c) at least one fluid intake valve open at one end to ambient air and in fluid communication with said series of chambers for allowing said at least one fluid into said series of chambers; and d) at least one fluid conveyor for conveying said at least one fluid between said series of chambers wherein said at least one fluid conveyor connects to alternating chambers in said series of chambers and said at least one fluid conveyor fluidly connects said first series of chamfers on said top layer with said second series if chambers on said bottom layer.

2. The cushioning system as in claim 1, further comprising a resilient material disposed within at least one of said series of chambers.

3. The cushioning system as in claim 2, wherein said resilient material is designed to resist the application of a load applied to said series of chambers.

4. The cushioning system as in claim 2, wherein said resilient material is designed to be porous to the passage of said at least one fluid.

5. The cushioning system as in claim 4, wherein said resilient material is made from polyurethane foam.

6. The cushioning system as in claim 1, wherein said series of chambers are designed as elongated chambers.

7. The cushioning system as in claim 6, wherein said series of elongated chambers are laid parallel to each other.

8. The device as in claim 1, wherein said series of chambers are designed by an airtight material.

9. The device as in claim 1, further comprising at least one manually actuatable relief valve.

10. The device as in claim 9, wherein said at least one manually actuatable relief valve is a twisty valve.

11. The device as in claim 9, wherein said at least one manually acutatable relief valve is a ball valve.

12. The device as in claim 9, wherein said at least one manually actuatable relief valve is a quick release connection.

13. The device as in claim 1, further comprising a pad disposed on top of said series of chambers.

14. The device as in claim 1, wherein said at least one fluid comprises air.

15. The device as in claim 1, wherein said at least one fluid comprises helium.

16. The device as in claim 1, further comprising at least one additional fluid wherein said at least one fluid comprises air and said at least one additional fluid comprises helium.

17. The device as in claim 1, wherein said at least one fluid conveyor comprises a series of pipes connected to alternating ones of said series of chambers, said series of pipes for conveying said at least one fluid from a first chamber to alternating chambers in said series of chambers.

18. The device as in claim 1, wherein said at least one fluid conveyor comprises a series of pipes connected to sa id series of chambers and a manifold connecting at least one set of alternating chambers in said series of chambers.

19. The device as in claim 2, wherein when a load is placed on said series of chambers, at least one of said series of chambers is compressed creating a vacuum, wherein when said load is released, said resilient material expands in said compressed chamber expanding said at least one compressed chamber causing said at least one fluid to enter said series of chambers so that said at least one fluid flows through said fluid conveyor to alternating chambers of said series of chambers.

20. The device as in claim 1, wherein said device forms a bed.

21. The device as in claim 1, wherein said device forms a seat cushion.

22. The device as in claim 1, wherein said series of chambers comprises at least eight chambers.

23. A method of cushioning a load comprising the following steps:

a) providing a series of chambers, said series of chambers comprising:
i) a first series of chambers forming a top layer;
ii) a second series of chambers forming a bottom layer;

b) providing at least one selectively openable air intake valve having one end open to ambient air and in fluid communication with said series of chambers;

c) providing at least one fluid conveyor for providing fluid communication between alternating chambers of said series of chambers;

d) applying a load to at least one of said series of chambers;

e) relieving at least a portion of said load from at least one of said series of chambers;

f) opening said at least one intake valve to receive said at least one fluid into said series of chambers; and g) communicating fluid from at least one of said series of chambers to an alternating one of said series of chambers wherein said at least one fluid flows through said at least one intake valve and communicates with alternating chambers in said series of chambers until a fluid pressure inside of said series of chambers balances with a pressure outside of said series of chambers.

24. A nonpowered cushioning device comprising:

a) a series of chambers wherein each of said series of chambers are disposed adjacent to each other, said series of chambers forming;
i) a first row of chambers formed by a first set of said series of chambers; and
ii) a second row of chambers formed by a second set of said series of chambers;

b) at least one fluid disposed within said series of chambers;

c) at least one fluid intake valve having at least one end open to ambient air and in fluid communication with said series of chambers for allowing said at least one fluid into said series of chambers; and d) at least one pipe connecting at least two of said series of chambers together and for conveying said at least one fluid between said series of chambers.

25. The device as in claim 24, wherein said second row is disposed below said first row.

26. The device as in claim 24, wherein said at least one pipe connects at least one chamber in said first row with at least one chamber in said second row.

27. The device as in claim 24, further comprising a manually actuatable relief valve in fluid communication with said series of chambers wherein said manually actuatable relief valve can release fluid from said series of chambers when opened.

28. The device as in claim 27, wherein said manually actuatable relief valve is a quick release connection.

29. The device as in claim 27, wherein said manually actuatable relief valve is a ball valve.

30. The device as in claim 27, wherein said manually actuatable relief valve is a twisty valve.

* * * * *

UNITED STATES PATENT AND TRADEMARK OFFICE

CERTIFICATE OF CORRECTION

PATENT NO. : 6,564,411 B2
DATED : May 20, 2003
INVENTOR(S) : S. Pirzada

It is certified that error appears in the above-identified patent and that said Letters Patent is hereby corrected as shown below:

Column 7,
Line 6, element d), please change “chamfers” to -- chambers --; and please change “if” to -- of --.

Signed and Sealed this

Eighteenth Day of May, 2004

JON W. DUDAS
*Acting Director of the United States Patent and Trademark Office*